US011100851B2

(12) United States Patent
Liu et al.

(10) Patent No.: US 11,100,851 B2
(45) Date of Patent: Aug. 24, 2021

(54) PIXEL CIRCUIT AND DRIVING METHOD THEREOF, DISPLAY DEVICE

(71) Applicant: BOE TECHNOLOGY GROUP CO., LTD., Beijing (CN)

(72) Inventors: Dongni Liu, Beijing (CN); Minghua Xuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/255,523

(22) PCT Filed: Jun. 29, 2020

(86) PCT No.: PCT/CN2020/098723
§ 371 (c)(1),
(2) Date: Dec. 23, 2020

(87) PCT Pub. No.: WO2021/000816
PCT Pub. Date: Jan. 7, 2021

(65) Prior Publication Data

US 2021/0201773 A1 Jul. 1, 2021

(30) Foreign Application Priority Data

Jul. 4, 2019 (CN) ..... 201910599791.7

(51) Int. Cl.
*G09G 3/32* (2016.01)

(52) U.S. Cl.
CPC ..... *G09G 3/32* (2013.01); *G09G 2310/061* (2013.01); *G09G 2330/028* (2013.01)

(58) Field of Classification Search
CPC ..... G09G 3/32; G09G 2310/061; G09G 2330/028
See application file for complete search history.

(56) References Cited

U.S. PATENT DOCUMENTS

2018/0174512 A1* 6/2018 Yuan ..... G09G 3/3233
2018/0277037 A1* 9/2018 Lin ..... G06F 3/0412
(Continued)

FOREIGN PATENT DOCUMENTS

CN 102376251 A 3/2012
CN 103296055 A 9/2013
(Continued)

OTHER PUBLICATIONS

China Patent Office, First Office Action dated May 31, 2021 for application No. CN201910599791.7.

*Primary Examiner* — Andrew Sasinowski
(74) *Attorney, Agent, or Firm* — Houtteman Law LLC

(57) ABSTRACT

The present disclosure provides a pixel circuit including: a reset circuit, a threshold compensation circuit, a data writing circuit, a light emitting control circuit and a driving transistor, where the reset circuit, the threshold compensation circuit, the data writing circuit and a control electrode of the driving transistor are coupled to a control node; the reset circuit is configured to write a reset voltage to the control node; the threshold compensation circuit is configured to perform threshold compensation on the driving transistor; the data writing circuit is configured to charge the control node according to a data voltage; the light emitting control circuit is configured to control a second electrode of the driving transistor to be electrically coupled to or decoupled from a first electrode of the light emitting element; the driving transistor is configured to output a corresponding driving current according to a voltage at the control node.

15 Claims, 7 Drawing Sheets

(56) References Cited

U.S. PATENT DOCUMENTS

| | | | | |
|---|---|---|---|---|
| 2019/0164498 | A1* | 5/2019 | Jang | G09G 3/3266 |
| 2019/0251904 | A1* | 8/2019 | Kim | G09G 3/3233 |
| 2019/0304372 | A1* | 10/2019 | Pyo | H01L 27/3262 |
| 2020/0043409 | A1* | 2/2020 | Liu | G09G 3/3233 |
| 2020/0051494 | A1* | 2/2020 | Wang | G09G 3/3233 |

FOREIGN PATENT DOCUMENTS

| | | | |
|---|---|---|---|
| CN | 104008723 | A | 8/2014 |
| CN | 109920371 | A | 6/2019 |
| KR | 20120070773 | A | 7/2012 |

* cited by examiner

PIXEL CIRCUIT AND DRIVING METHOD THEREOF, DISPLAY DEVICE

CROSS REFERENCE TO RELATED APPLICATIONS

The present application claims priority to Chinese patent application No. 201910599791.7, filed on Jul. 4, 2019, the contents of which are incorporated herein by reference in their entirety.

TECHNICAL FIELD

The present disclosure relates to the field of display technology, and in particular, to a pixel circuit and a driving method thereof, and a display device.

BACKGROUND

A procedure for displaying a frame of picture by a display device at least includes a driving stage and a displaying stage, the driving stage is used for writing of a data signal, and the displaying stage is used for displaying the frame of picture; a duration of the displaying stage for the frame of picture directly affects a display effect of the frame of picture.

SUMMARY

An embodiment of the present disclosure provides a pixel circuit, including: a reset circuit, a threshold compensation circuit, a data writing circuit, a light emitting control circuit and a driving transistor, where the reset circuit, the threshold compensation circuit, the data writing circuit and a control electrode of the driving transistor are coupled to a control node;

the reset circuit is coupled to a reset control line and a reset power supply terminal and is configured to write a reset voltage provided by the reset power supply terminal into the control node under control of the reset control line;

the threshold compensation circuit is coupled to a compensation control line and is configured to perform threshold compensation on the driving transistor under control of the compensation control line;

the data writing circuit is coupled to a corresponding first gate line and a corresponding first data line and is configured to charge the control node according to a data voltage provided by the first data line under control of the first gate line;

the light emitting control circuit is coupled to a second electrode of the driving transistor, a light emitting control line and a first electrode of a light emitting element and is configured to control the second electrode of the driving transistor to be electrically coupled to or decoupled from the first electrode of the light emitting element under control of the light emitting control line;

a first electrode of the driving transistor is coupled to a first operating power supply terminal, and the driving transistor is configured to output a corresponding driving current according to a voltage at the control node in response to that the second electrode of the driving transistor is electrically coupled to the first electrode of the light emitting element.

In some implementations, the threshold compensation circuit includes: a first transistor;

a control electrode of the first transistor is coupled to the compensation control line, a first electrode of the first transistor is coupled to the control node, and a second electrode of the first transistor is coupled to the second electrode of the driving transistor.

In some implementations, the reset circuit includes: a second transistor;

a control electrode of the second transistor is coupled to the reset control line, a first electrode of the second transistor is coupled to the control node, and a second electrode of the second transistor is coupled to the reset power supply terminal.

In some implementations, the data writing circuit includes: a third transistor and a first capacitor;

a control electrode of the third transistor is coupled to the first gate line, a first electrode of the third transistor is coupled to the first data line, and a second electrode of the third transistor is coupled to a first electrode of the first capacitor;

a second electrode of the first capacitor is coupled to the control node.

In some implementations, the light emitting control circuit includes: a fourth transistor;

a control electrode of the fourth transistor is coupled to the light emitting control line, a first electrode of the fourth transistor is coupled to the second electrode of the driving transistor, and a second electrode of the fourth transistor is coupled to the first electrode of the light emitting element.

In some implementations, the light emitting control circuit includes: a fourth transistor, a fifth transistor, a sixth transistor, and a second capacitor;

a control electrode of the fourth transistor is coupled to the light emitting control line, a first electrode of the fourth transistor is coupled to the second electrode of the driving transistor, and a second electrode of the fourth transistor is coupled to a first electrode of the sixth transistor;

a control electrode of the fifth transistor is coupled to a second gate line, a first electrode of the fifth transistor is coupled to a second data line, and a second electrode of the fifth transistor is coupled to a control electrode of the sixth transistor;

the control electrode of the sixth transistor is coupled to a first electrode of the second capacitor, and a second electrode of the sixth transistor is coupled to the first electrode of the light emitting element;

a second electrode of the second capacitor is coupled to a common power supply terminal.

In some implementations, all of transistors in the pixel circuit are N-type transistors; or all of transistors in the pixel circuit are P-type transistors.

An embodiment of the present disclosure further provides a display device, including: a display substrate including a plurality of light emitting elements, and at least one of the light emitting elements is coupled to the pixel circuit described above.

In some implementations, each of light emitting elements, more than or equal to 2 in number, in the plurality of light emitting elements is coupled to the pixel circuit;

at least two pixel circuits are simultaneously coupled to a same reset control line, at least two pixel circuits are simultaneously coupled to a same compensation control line, and at least two pixel circuits are simultaneously coupled to a same light emitting control line.

An embodiment of the present disclosure further provides a driving method of a pixel circuit, where the pixel circuit is the aforementioned pixel circuit, and the driving method of the pixel circuit includes:

in a reset stage, controlling, by the light emitting control circuit, the second electrode of the driving transistor to be electrically decoupled from the first electrode of the light emitting element under control of the light emitting control line; and writing, by the reset circuit, a reset voltage provided by the reset power supply terminal into the control node under control of the reset control line;

in a compensation stage, controlling, by the light emitting control circuit, the second electrode of the driving transistor to be electrically decoupled from the first electrode of the light emitting element under control of the light emitting control line; and performing, by the threshold compensation circuit, threshold compensation on the driving transistor under control of the compensation control line;

in a driving sub-stage of a driving stage, charging, by the data writing circuit, the control node according to a data voltage provided by the first data line under control of the first gate line;

in at least a portion of time period in a displaying stage, controlling, by the light emitting control circuit, the second electrode of the driving transistor to be electrically coupled to the first electrode of the light emitting element under control of the light emitting control line, and outputting, by the driving transistor, a corresponding driving current according to a voltage at the control node.

An embodiment of the present disclosure further provides a driving method for a plurality of pixel circuits, where each of the pixel circuits is the aforementioned pixel circuit, the pixel circuits correspond to at least two first gate lines, and the driving method for the plurality of pixel circuits includes:

in a reset stage, simultaneously controlling, by light emitting control circuits in all the pixel circuits, second electrodes of driving transistors to be electrically decoupled from first electrodes of light emitting elements in the pixel circuits under control of light emitting control lines; and writing, by reset circuits in all the pixel circuits, reset voltages provided by reset power supply terminals into control nodes in the pixel circuits under control of reset control lines;

in a compensation stage, simultaneously maintaining, by the light emitting control circuits in all the pixel circuits, the second electrodes of the driving transistors to be electrically decoupled from the first electrodes of the light emitting elements in the pixel circuits under control of the light emitting control lines; and simultaneously performing, by threshold compensation circuits in all the pixel circuits, threshold compensations on the driving transistors in the pixel circuits under control of compensation control lines;

in any one driving sub-stage of driving sub-stages sequentially performed in a driving stage, charging, by the data writing circuit in the pixel circuit corresponding to the driving sub-stage, the control node according to a data voltage provided by the corresponding first data line under control of the corresponding first gate line;

in at least a portion of time period in a displaying stage, controlling, by the light emitting control circuits in all the pixel circuits, the second electrodes of the driving transistors to be electrically coupled to the first electrodes of the light emitting elements in the pixel circuits under control of the light emitting control lines, and outputting, by the driving transistors in the pixel circuits, corresponding driving currents according to voltages at the control nodes.

DESCRIPTION OF EMBODIMENTS

Figure 1:
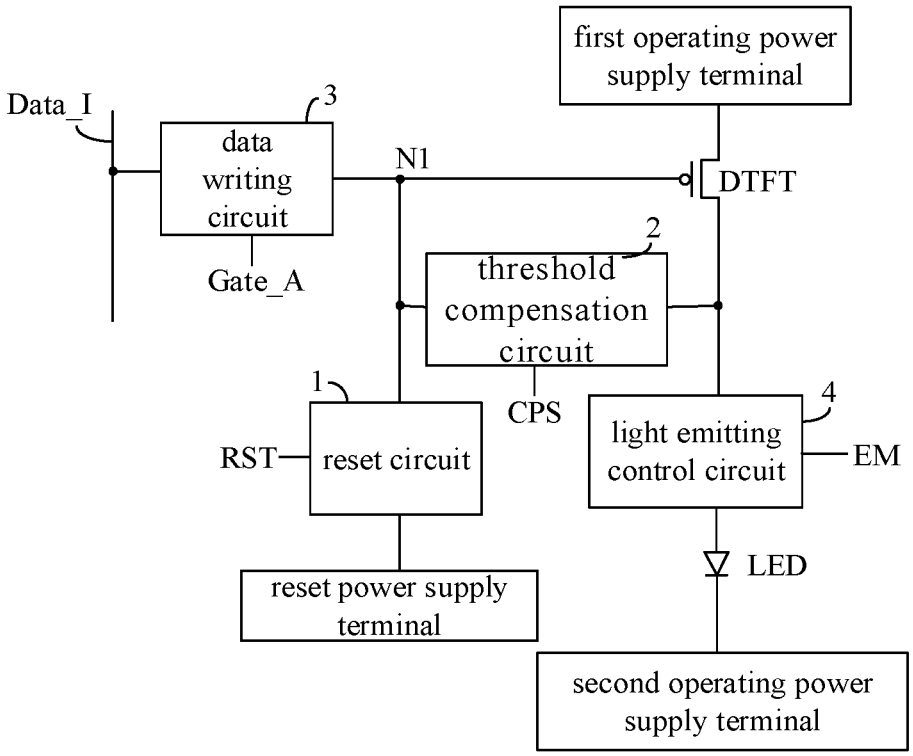
FIG. 1 is a schematic diagram of a circuit structure of a pixel circuit according to an embodiment of the present disclosure.

In order to make those skilled in the art better understand technical solutions of the present disclosure, the following describes a pixel circuit, a driving method thereof, and a display device provided in the present disclosure in detail with reference to the accompanying drawings.

In the related art, a procedure for displaying a frame of picture can be divided into a driving stage and a displaying stage, where the driving stage includes n driving sub-stages, and in the $i^{th}$ driving sub-stage, pixel circuits in the $i^{th}$ row of a display panel complete an operation of writing a data voltage and an operation of threshold compensation for driving transistors; generally, a minimum time duration required for the pixel circuit to complete the operation of writing the data voltage is Td, and a minimum time duration required for the pixel circuit to complete the operation of threshold compensation for the driving transistor is Tc, which is much longer than Td (for example, Tc is generally four times Td).

In order to increase a duration of the displaying stage to improve light emitting efficiency of the light emitting element, in the related art, the pixel circuit is designed to synchronously perform the operation of writing the data voltage and the operation of threshold compensation on the driving transistor in the corresponding driving sub-stage, so as to shorten a duration of the driving sub-stage, where the duration of one driving sub-stage is Tc, and a total duration of the entire driving stage is $n \times Tc$. Assuming that a time period of a frame is T, a total duration of the displaying stage is $T-n \times Tc$.

However, it is found that the duration of the above displaying stage is still too short, which may affect uniformity of displaying.

In order to solve the problem that the duration of the displaying stage in a frame of picture is too short in the related art, the present disclosure provides a corresponding technical solution.

It should be noted that the light emitting element in the present disclosure may be a current-driven light emitting element including an LED (Light Emitting Diode), a Micro-LED (Micro Light Emitting Diode), an OLED (Organic Light Emitting Diode), and the like in the related art, and the light emitting element being the LED is taken as example in the following embodiments for illustration.

In addition, each of transistors according to the present disclosure may be independently selected from one of a polycrystalline silicon thin film transistor, an amorphous silicon thin film transistor, an oxide thin film transistor, and an organic thin film transistor. A "control electrode" of a transistor referred to in the present disclosure specifically refers to a gate electrode of the transistor, a "first electrode" of the transistor specifically refers to a source electrode of the transistor, and correspondingly, a "second electrode" of the transistor specifically refers to a drain electrode of the transistor. Certainly, one skilled in the art will recognize that the "first electrode" and the "second electrode" may be interchanged.

In addition, transistors can be divided into N-type transistors and P-type transistors, and each transistor in the present disclosure can be independently selected from an N-type transistor or a P-type transistor; in the following embodiments, the transistors being all P-type transistors is taken as an example for illustrative description, which does not limit the technical solutions of the present disclosure.

FIG. 1 is a schematic diagram of a circuit structure of a pixel circuit according to an embodiment of the present disclosure, and as shown in FIG. 1, the pixel circuit includes: a reset circuit 1, a threshold compensation circuit 2, a data writing circuit 3, a light emitting control circuit 4, and a driving transistor DTFT, and the reset circuit 1, the threshold compensation circuit 2, the data writing circuit 3, and a control electrode of the driving transistor DTFT are coupled to a control node N1.

The reset circuit 1 is coupled to a reset control line RST and a reset power supply terminal, and the reset circuit 1 is configured to write a reset voltage provided by the reset power supply terminal to the control node N1 under control of the reset control line RST.

The threshold compensation circuit 2 is coupled to a compensation control line CPS, and the threshold compensation circuit 2 is configured to perform threshold compensation on the driving transistor DTFT under control of the compensation control line CPS.

The data writing circuit 3 is coupled to a corresponding first gate line Gate_A and a corresponding first data line data_I, and the data writing circuit 3 is configured to charge the control node N1 according to a data voltage provided by the first data line Data_I under control of the first gate line Gate_A.

The light emitting control circuit 4 is coupled to a second electrode of the driving transistor DTFT, a light emitting control line EM, and a first electrode of the light emitting element LED, and the light emitting control circuit 4 is configured to control the second electrode of the driving transistor DTFT to be electrically coupled to or decoupled from the first electrode of the light emitting element LED under control of the light emitting control line.

A first electrode of the driving transistor DTFT is coupled to a first operating power supply terminal, and the driving transistor DTFT is configured to output a corresponding driving current according to a voltage at the control node N1 in response to that the second electrode of the driving transistor DTFT is electrically coupled to the first electrode of the light emitting element LED; a second electrode of the light emitting element LED is coupled to a second operating power supply terminal.

In the technical solution of the present disclosure, a time period of a frame may be divided into the following stages: a reset stage, a compensation stage, a driving stage and a displaying stage. The reset stage, the compensation stage and the driving stage are performed sequentially, the driving stage includes a plurality of driving sub-stages that are performed sequentially, the displaying stage may be started after the driving stage is finished or may be started after the compensation stage is finished and in synchronization with the driving stage, and for the detailed description of each stage, reference may be made to the following contents.

In the pixel circuit provided in the present disclosure, the reset circuit 1 performs a reset process on the control node N1 in the reset stage, the threshold compensation circuit 2 performs a threshold compensation process on the driving transistor DTFT in the compensation stage, the data writing circuit 3 performs a data writing process in a corresponding driving sub-stage, and the light emitting control circuit 4 controls the second electrode of the driving transistor DTFT to be electrically coupled to the first electrode of the light emitting element LED during at least a portion of time period in the displaying stage, so that the driving transistor DTFT can provide a driving current to the light emitting element LED.

In the present disclosure, the pixel circuit respectively performs the threshold compensation process and the data writing process in the compensation stage and the driving stage, so that a duration of each driving sub-stage included in the driving stage for a frame can be correspondingly shortened (in the related art, a minimum duration corresponding to a driving sub-stage is a minimum duration Tc required by the threshold compensation process on the driving transistor DTFT, and in the present disclosure, a minimum duration corresponding to a driving sub-stage is a minimum duration Td required by the data writing process). It can be seen that, a total duration of the driving stage can be shorten significantly by the technical solution of the present disclosure, which facilitates to increase the duration of the displaying stage for a frame, so that the light emitting efficiency of the light emitting element LED can be improved effectively.

It should be noted that, although in the technical solution of the present disclosure, one reset stage and one compensation stage are added for displaying a frame (when a plurality of pixel circuits provided by the present disclosure are included in a display panel, the plurality of pixel circuits perform reset processes in a same reset stage at the same time, and perform threshold compensation processes in a same compensation stage at the same time), a sum of time durations corresponding to the reset stage and the compensation stage is much shorter than a reduced amount of a total time duration of the driving stage, so that, in a case where the time duration corresponding to the frame is constant, the time duration of the driving stage in the technical solution of the present disclosure is smaller than the time duration of the driving stage in the related art.

Figure 2:
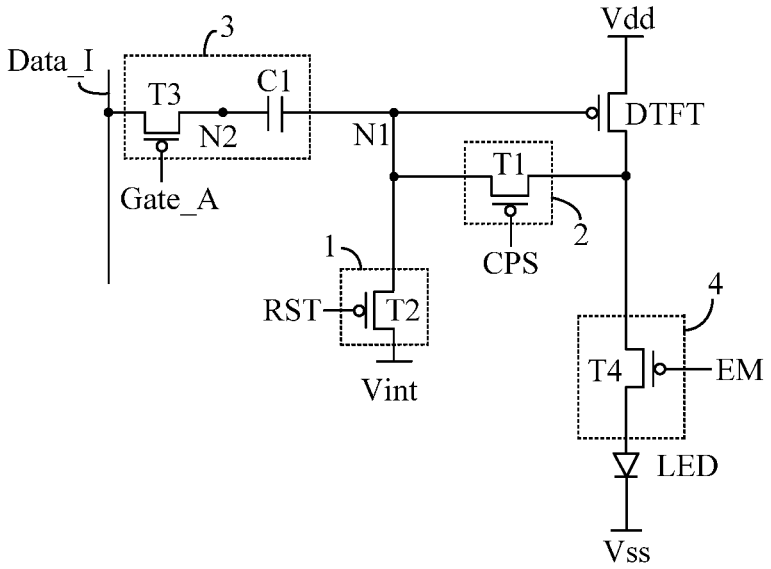
FIG. 2 is a schematic diagram of another circuit structure of a pixel circuit according to an embodiment of the present disclosure.

FIG. 2 is a schematic diagram of another circuit structure of a pixel circuit provided in an embodiment of the present disclosure, and as shown in FIG. 2, the pixel circuit is a specific example of the pixel circuit shown in FIG. 1.

In some implementations, the threshold compensation circuit 2 includes: a first transistor T1; a control electrode of the first transistor T1 is coupled to the compensation control line CPS, a first electrode of the first transistor T1 is coupled to the control node N1, and a second electrode of the first transistor T1 is coupled to the second electrode of the driving transistor DTFT.

In some implementations, the reset circuit 1 includes: a second transistor T2; a control electrode of the second transistor T2 is coupled to the reset control line RST, a first electrode of the second transistor T2 is coupled to the control node N1, and a second electrode of the second transistor T2 is coupled to the reset power supply terminal.

In some implementations, the data writing circuit 3 includes: a third transistor T3 and a first capacitor C1; a control electrode of the third transistor T3 is coupled to the first gate line Gate_A, a first electrode of the third transistor T3 is coupled to the first data line Data_I, and a second electrode of the third transistor T3 is coupled to a first electrode of the first capacitor C1; a second electrode of the first capacitor C1 is coupled to the control node N1.

In some implementations, the light emitting control circuit 4 includes: a fourth transistor T4; a control electrode of the fourth transistor T4 is coupled to the light emitting control line EM, a first electrode of the fourth transistor T4 is coupled to the second electrode of the driving transistor DTFT, and a second electrode of the fourth transistor T4 is coupled to the first electrode of the light emitting element LED.

The first electrode of the driving transistor DTFT is coupled to the first operating power supply terminal and the second electrode of the light emitting element LED is coupled to the second operating power supply terminal.

An operation of the pixel circuit shown in FIG. 2 will be described in detail with reference to the accompanying drawings. The first operating power supply terminal provides a high level operating voltage Vdd, the second operating power supply terminal provides a low level operating voltage Vss, the reset power supply terminal provides a reset voltage Vint, an initial voltage provided by the data line is Vref, and a data voltage provided by the data line is Vdata_I; where the reset voltage Vint is a low level voltage, and a value of Vdata_I−Vref is negative.

Figure 3:
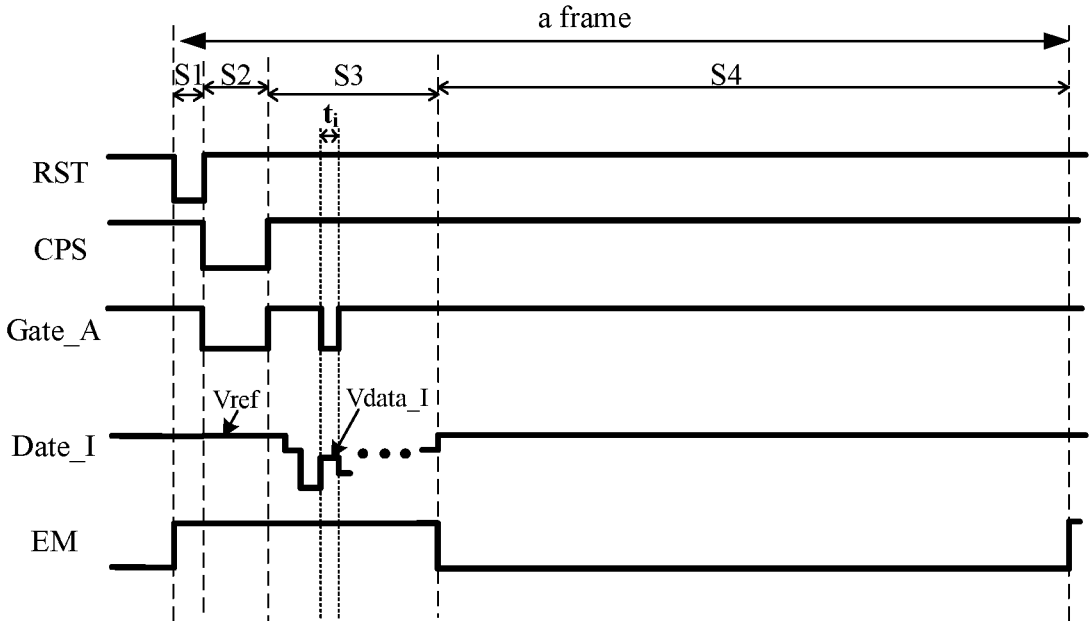
FIG. 3 is a timing diagram illustrating an operation of the pixel circuit shown in FIG. 2.

FIG. 3 is a timing diagram illustrating an operation of the pixel circuit shown in FIG. 2, and as shown in FIG. 3, the operation of the pixel circuit is as follows.

In the reset stage S1, a reset control signal provided by the reset control line RST is at a low level, a compensation control signal provided by the compensation control line CPS is at a high level, a light emitting control signal provided by the light emitting control line EM is at a high level, a gate driving signal provided by the first gate line Gate_A is at a high level, and the data line provides the initial voltage Vref. At this time, the second transistor T2 is turned on, and the first transistor T1, the third transistor T3, and the fourth transistor T4 are all turned off.

Since the second transistor T2 is turned on, the reset voltage Vint is written to the control node N1 through the second transistor T2, and the voltage at the control node N1 is Vint.

In the compensation stage S2, the reset control signal provided by the reset control line RST is at a high level, the compensation control signal provided by the compensation control line CPS is at a low level, the light emitting control signal provided by the light emitting control line EM is at a high level, the gate driving signal provided by the first gate line Gate_A is at a low level, and the data line provides the initial voltage Vref. At this time, the first transistor T1 and the third transistor T3 are both turned on, and the second transistor T2 and the fourth transistor T4 are both turned off.

Since the third transistor T3 is turned on, the initial voltage Vref is written to a node N2 through the third transistor T3, and the voltage at the node N2 is Vref. Since the first transistor T1 is turned on, the driving transistor DTFT outputs a current and charges the control node N1 through the first transistor T1, the voltage at the control node N1 rises from Vint, until the voltage at the control node N1 rises to Vdd+Vth, the driving transistor DTFT is turned off, the charging is finished, and the threshold compensation process on the driving transistor DTFT is completed; where Vth is a threshold voltage of the driving transistor DTFT (Vth is generally less than 0V). At the end of the compensation stage S2, a voltage difference across two electrodes of the first capacitor C1 is Vref−Vdd−Vth.

The driving stage S3 includes a plurality of driving sub-stages; in the driving sub-stage corresponding to the pixel circuit, the reset control signal provided by the reset control line RST is at a high level, the compensation control signal provided by the compensation control line CPS is at a high level, the light emitting control signal provided by the light emitting control line EM is at a high level, the gate driving signal provided by the first gate line Gate_A is at a low level, and the data line provides the data voltage Vdata_I. At this time, the third transistor T3 is turned on, and the first transistor T1, the second transistor T2, and the fourth transistor T4 are all turned off.

Since the first transistor T1 and the second transistor T2 are turned off, the control node N1 is in a floating state. Meanwhile, since the third transistor T3 is turned on, the data voltage Vdata_I is written to the node N2 through the third transistor T3, and under a bootstrap action of the first capacitor C1, the voltage at the control node N1 jumps from Vdd+Vth to Vdd+Vth+Vdata_I−Vref, at this time, a gate-source voltage Vgs of the driving transistor DTFT is equivalent to Vth+Vdata_I−Vref, that is Vgs=Vth+Vdata_I−Vref, and since Vdata_I−Vref<0, Vgs<Vth.

It should be noted that, when the driving sub-stage ti is neither the first driving sub-stage in the driving stage S3 nor the last driving sub-stage in the driving stage S3, in any other driving sub-stage before the driving sub-stage t, the gate driving signal provided by the first gate line Gate_A is at a high level, so the node N2 is in a floating state, and the voltage at the node N1 is maintained at Vref at the end of the compensation stage S2. In any other driving sub-stage following the driving sub-stage ti, the gate driving signal provided by the first gate line Gate_A is at a high level, so the node N2 is in a floating state, and the voltage at the node N2 is maintained at Vdd+Vth+Vdata_I−Vref at the end of the driving sub-stage ti.

When the driving sub-stage ti is the first driving sub-stage in driving stage S3, there is not any other driving sub-stage between the driving sub-stage ti and the compensation stage S2. When the driving sub-stage ti is the last driving sub-stage in the driving stage S3, there is not any other driving sub-stage between the driving sub-stage ti and the displaying stage S4.

In the displaying stage S4, the reset control signal provided by the reset control line RST is at a high level, the compensation control signal provided by the compensation control line CPS is at a high level, the light emitting control signal provided by the light emitting control line EM is at a low level, the gate driving signal provided by the first gate line Gate_A is at a high level, and the data line provides the initial voltage Vref. At this time, the fourth transistor T4 is turned on, and the first transistor T1, the second transistor T2, and the third transistor T3 are all turned off.

Since the gate-source voltage Vgs of the driving transistor DTFT is less than the threshold voltage Vth of the driving transistor DTFT at this time, that is, Vgs<Vth, the driving transistor DTFT is turned on. It can be obtained as follows according to a formula of saturated driving current of the driving transistor DTFT:

$$I = K*(Vgs - Vth)^2$$
$$= K*(Vth + \text{Vdata_I} - Vref - Vth)^2$$
$$= K*(\text{Vdata_I} - Vref)^2$$

where K is a constant determined by electrical characteristics of the driving transistor DTFT. As can be seen from the above formula, the driving current of the driving transistor DTFT is only related to the data voltage and the reference voltage, but is not related to the threshold voltage Vth of the driving transistor DTFT, so that the driving current flowing through the light emitting element LED is prevented from being affected by non-uniformity and drift of the threshold voltage of the driving transistor DTFT, and uniformity of the driving current flowing through the light emitting element LED is effectively improved.

It should be noted that the case where the light emitting control signal provided by the light emitting control line EM is at the low level throughout the displaying stage S4 is only an example of the present disclosure, and in the present disclosure, the light emitting control signal may be at the low level for at least a portion of time period in the displaying stage S4.

As an application scenario, the light emitting control signal is at the low level in a portion of time period in the displaying stage S4, and by controlling the duration of the light emitting control signal being at the low level in the displaying stage S4, an equivalent brightness of the light emitting element LED in a frame can be controlled, so as to achieve various brightness adjustments.

As another application scenario, while the driving current output by the driving transistor DTFT is increased (a magnitude of Vdata_I is adjusted), the light emitting control signal is controlled to be switched between the high level and the low level multiple times in the displaying stage S4 (the light emitting element LED is switched between on and off multiple times in the displaying stage S4), and the equivalent brightness of the light emitting element LED in the frame is made equal to a desired brightness. In the above procedure, since the current outputted by the driving transistor DTFT is a relative large current (having a high current density), the light emitting element LED is always in a high gray level state when it is turned on, and thus the light emitting element LED has high light emitting efficiency without color shift.

Figure 4:
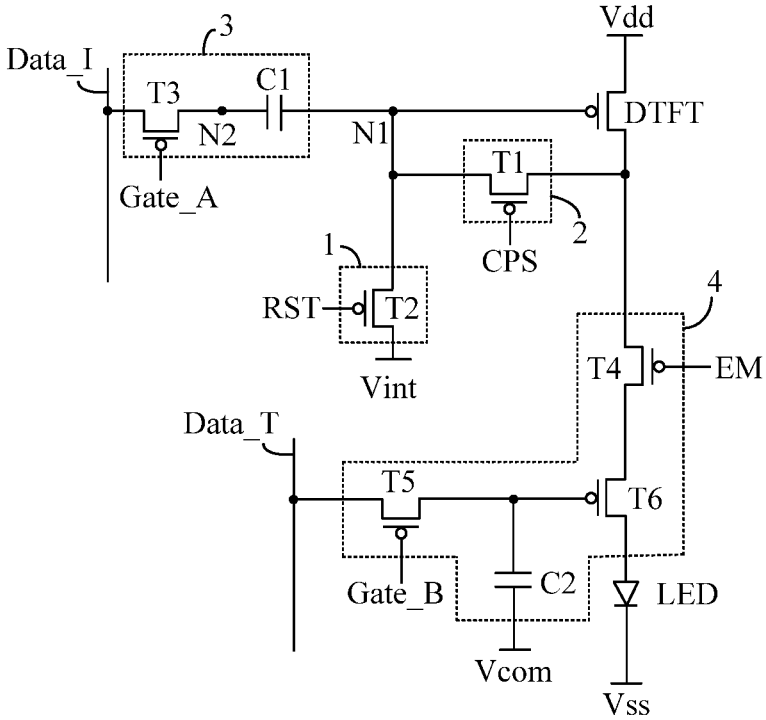
FIG. 4 is a schematic diagram of further another circuit structure of a pixel circuit according to an embodiment of the present disclosure.

FIG. 4 is a schematic diagram of another circuit structure of a pixel circuit provided in an embodiment of the present disclosure, and as shown in FIG. 4, unlike the pixel circuit shown in FIG. 2, the light emitting control circuit 4 in the present embodiment includes not only the fourth transistor T4, but also a fifth transistor T5, a sixth transistor T6, and a second capacitor C2.

A control electrode of the fourth transistor T4 is coupled to the light emitting control line EM, a first electrode of the fourth transistor T4 is coupled to the second electrode of the driving transistor DTFT, and a second electrode of the fourth transistor T4 is coupled to a first electrode of the sixth transistor T6.

A control electrode of the fifth transistor T5 is coupled to a second gate line Gate_B, a first electrode of the fifth transistor T5 is coupled to a second data line Data_T, and a second electrode of the fifth transistor T5 is coupled to a control electrode of the sixth transistor T6.

The control electrode of the sixth transistor T6 is coupled to a first electrode of the second capacitor C2, and a second electrode of the sixth transistor T6 is coupled to the first electrode of the light emitting element LED; a second electrode of the second capacitor C2 is coupled to a common power supply terminal, which supplies a common voltage Vcom.

Figure 5:
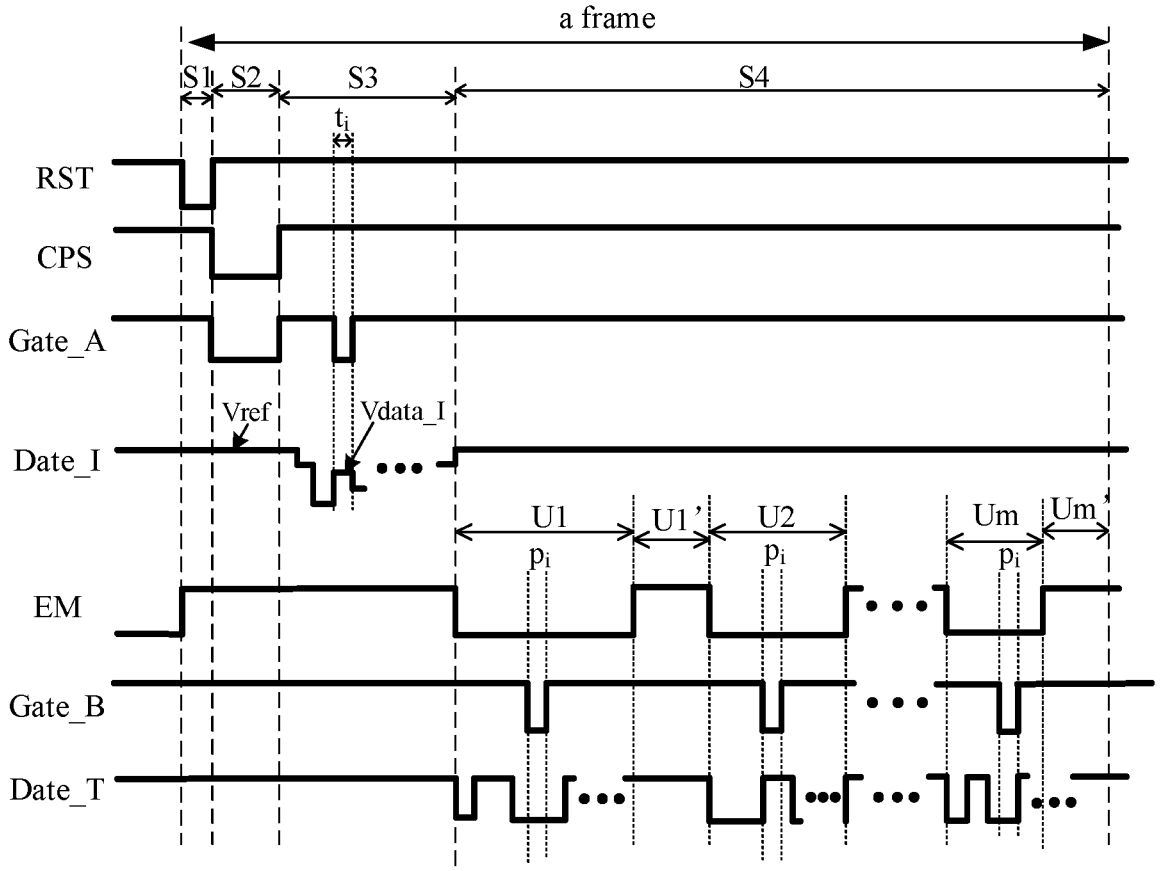
FIG. 5 is a timing diagram illustrating an operation of the pixel circuit shown in FIG. 4.

FIG. 5 is a timing diagram illustrating an operation of the pixel circuit shown in FIG. 4, and as shown in FIG. 5, the operation of the pixel circuit is as follows.

Based on the timing of operation shown in FIG. 5, operation processes of the pixel circuit shown in FIG. 4 in the reset stage S1, the compensation stage S2 and the driving stage S3 are the same as operation processes of the pixel circuit shown in FIG. 2 in the reset stage S1, the compensation stage S2 and the driving stage S3 based on the timing of operation shown in FIG. 3, and are not repeated herein. Only the displaying stage S4 will be described in detail below.

In the present embodiment, the displaying stage S4 includes: a plurality of scanning periods U1 to Um and a plurality of non-light emitting periods U1' to Um' which are alternately performed. It should be noted that durations of the scanning periods U1 to Um may be the same or different; durations of the non-light emitting periods U1' to Um' may be the same or different. It is only necessary to ensure that all second gate lines Gate_B in a display device can complete scanning within each of the scanning periods U1 to Um.

In the non-light emitting periods U1' to Um', the light emitting control signal provided by the light emitting control line EM is always at the high level, and thus the fourth transistor T4 is turned off, the driving transistor DTFT cannot supply the driving current to the light emitting element LED, and the light emitting element LED does not emit light.

Each of the scanning periods U1 to Um includes at least a plurality of scanning sub-stages, and each scanning sub-stage corresponds to a row of pixel units in the display panel. In the present embodiment, it is assumed that the pixel circuit shown in FIG. 4 corresponds to the $i^{th}$ scanning sub-stage $p_i$ in the corresponding scanning period, that is, a scanning signal provided by the second gate line Gate_B coupled to the pixel circuit is at a low level in the scanning sub-stage $p_i$, and is at a high level at other time periods in a frame; that is, the fifth transistor T5 is turned on only during the corresponding scanning sub-stage $p_i$, and is turned off at other time periods in the frame.

In each scanning sub-stage $p_i$ corresponding to the pixel circuit, the second data line Data_T provides a data voltage Vdata_T, where Vdata_T may be a high level voltage or a low level voltage (selected as needed).

When the Vdata_T is the low level voltage, the Vdata_T is written into the control electrode of the sixth transistor T6 through the fifth transistor T5, the sixth transistor T6 is turned on, the second electrode of the driving transistor DTFT is electrically coupled to the first electrode of the light emitting element LED, the driving current output from the driving transistor DTFT sequentially flows through the fourth transistor T4 and the sixth transistor T6, and flows into the light emitting element LED, and the light emitting element LED emits light. In a time period from the end of the scanning sub-stage $p_i$ to the start of the next non-light emitting period, the control electrode of the sixth transistor T6 is in a floating state, the sixth transistor T6 is kept to be turned on, and the light emitting element LED keeps emitting light.

When the Vdata_T is the high level voltage, the Vdata_T is written to the control electrode of the sixth transistor T6 through the fifth transistor T5, the sixth transistor T6 is turned off, the second electrode of the driving transistor DTFT is electrically decoupled from the first electrode of the light emitting element LED, and the light emitting element LED does not emit light.

Therefore, in each scanning period, whether the pixel circuit emits light in each scanning period can be effectively controlled by controlling a magnitude of the Vdata_T provided by the second data line Data_T coupled to the pixel circuit.

It should be noted that, in the present disclosure, durations of the scanning periods may be equal or different, all of which fall into the protection scope of the present disclosure.

In the present embodiment, in the displaying stage S4, a time duration of light emitting of the light emitting element LED in the displaying stage S4 can be effectively controlled by the light emitting control signal provided by the light emitting control line and the data voltage Vdata_T provided by the second data line Data_T.

Figure 6:
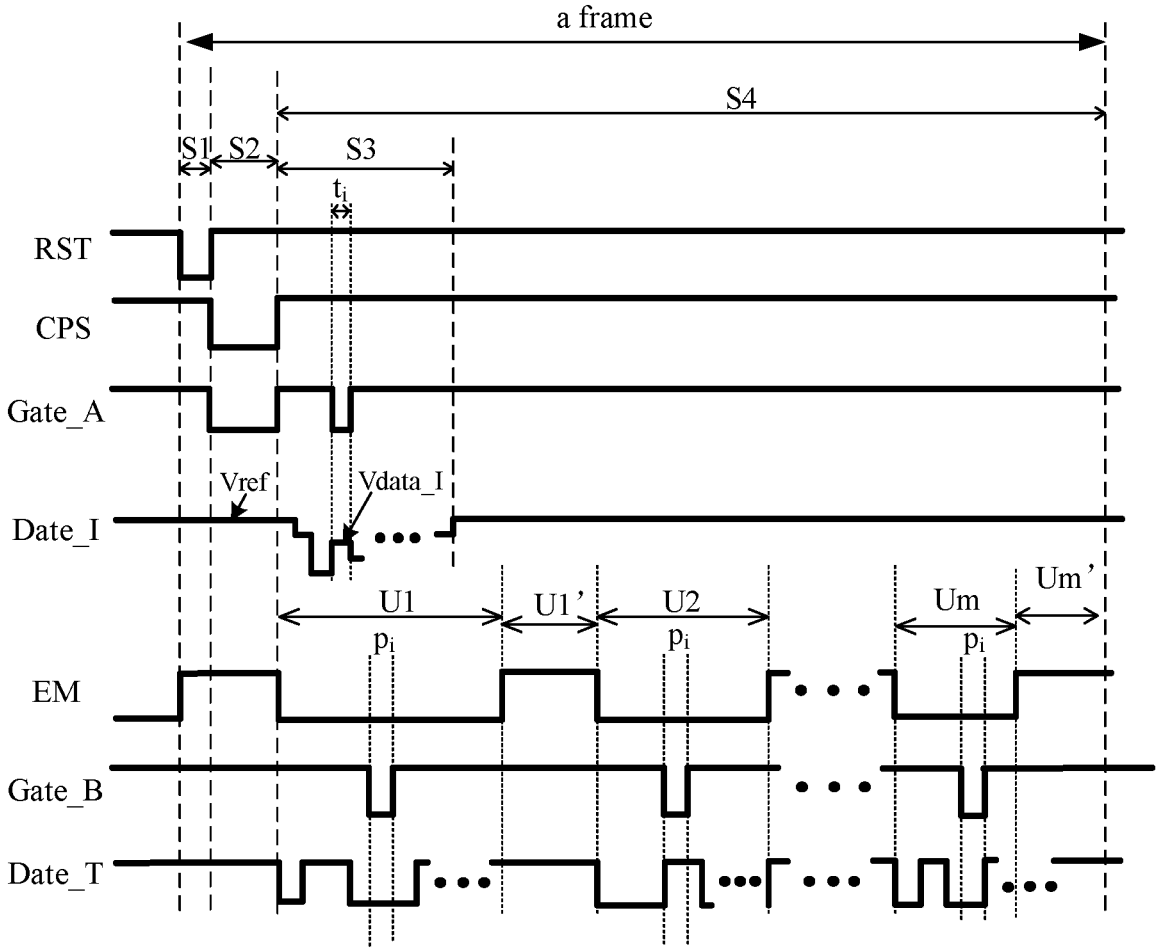
FIG. 6 is a timing diagram illustrating another operation of the pixel circuit shown in FIG. 4.

FIG. 6 is a timing diagram of another operation of the pixel circuit shown in FIG. 4, and as shown in FIG. 6, different from FIG. 5, the displaying stage S4 shown in FIG. 6 starts synchronously with the driving stage S3 after the compensation stage S2 ends, so as to further increase the total duration of the displaying stage S4.

For operation processes of the pixel circuit shown in FIG. 4 in the reset stage S1, the compensation stage S2, the driving stage S3 and the displaying stage S4 based on the timing of operation shown in FIG. 6, reference may be made to the foregoing descriptions, and details are not repeated herein.

It should be noted that, the case that all transistors in the pixel circuit are P-type transistors is only an example of the present disclosure, which can make all transistors in the pixel circuit to be manufactured by using a same manufacturing process, thereby effectively shortening a manufacturing period. Similarly, the same technical effect can be achieved when all transistors in the pixel circuit are N-type transistors.

Figure 7:
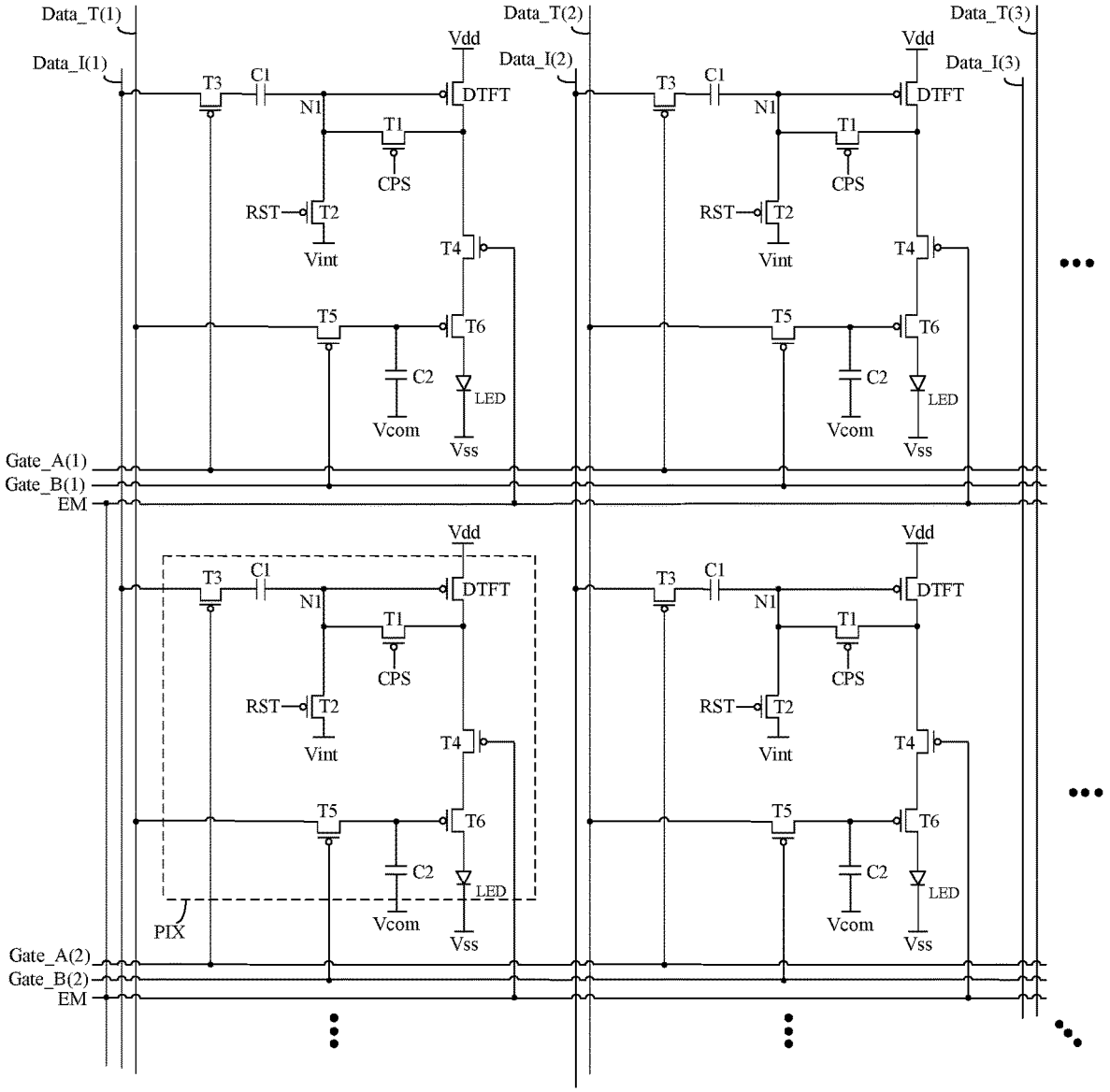
FIG. 7 is a schematic diagram of a circuit structure of a display device according to an embodiment of the present disclosure.

FIG. 7 is a schematic diagram of a circuit structure of a display device according to an embodiment of the present disclosure, and as shown in FIG. 7, the display device includes a display substrate, and the display substrate includes a plurality of light emitting element LEDs, and at least one of the light emitting element LEDs is coupled to the pixel circuit PIX provided by any one of the above embodiments. For a specific description of the pixel circuit PIX, reference may be made to the descriptions of the foregoing embodiments, and details are not repeated herein.

In some implementations, each of light emitting elements LED, more than or equal to 2 in number, is coupled to the pixel circuit PIX provided in the foregoing embodiment; it should be noted that FIG. 7 exemplarily shows four pixel circuits PIX shown in FIG. 4, and this case is only for exemplary purposes and does not limit the technical solution of the present disclosure.

In a pixel array formed by a plurality of pixel circuits PIX, the pixel circuits PIX located in a same row correspond to a same first gate line Gate_A(1)/Gate_A(2), and the pixel circuits PIX located in a same column correspond to a same first data line Data_I(1)/Data_I(2)/Data_I(3).

It should be noted that, in the display device shown in FIG. 7, only two first gate lines Gate_A(1)/Gate_A(2) and three first data lines Data_I(1)/Data_I(2)/Data_I(3) are exemplarily drawn, and this case only serves as an example, and does not limit the technical solution of the present disclosure.

In some implementations, at least two pixel circuits PIX in the display device are coupled to a same reset control line RST, at least two pixel circuits PIX in the display device are coupled to a same compensation control line CPS, and at least two pixel circuits PIX in the display device are coupled to a same light emitting control line EM.

In some implementations, the reset control line RST corresponding to each pixel circuit PIX in the display device is electrically coupled to the reset control line RST corresponding to another pixel circuit PIX, the compensation control line CPS corresponding to each pixel circuit PIX is electrically coupled to the compensation control line CPS corresponding to another pixel circuit PIX, and the light emitting control line EM corresponding to each pixel circuit PIX is electrically coupled to the light emitting control line EM corresponding to another pixel circuit PIX. At this time, all the pixel circuits PIX can be controlled by the same reset control line RST to perform the reset process on the respective control nodes N1 therein at the same time, and all the pixel circuits PIX can be controlled by the same compensation control line CPS to perform the threshold compensation process on the respective driving transistors DTFT therein at the same time.

In the present embodiment, assuming that a time duration of a frame is T, the driving stage includes n driving sub-stages ($n \geq 2$), and in the $i^{th}$ driving sub-stage, the pixel circuits in the $i^{th}$ row of a display panel complete an operation of writing the data voltage; in addition, a minimum time duration required for the pixel circuit to complete the operation of writing the data voltage is Td, a minimum time duration required for the pixel circuit to complete an operation of threshold compensation for the driving transistor DTFT is Tc, and a minimum time duration required for the pixel circuit to complete an operation of reset for the control node N1 is Ta (Ta is approximately equal to Td).

In the present disclosure, a sum of minimum time durations of the reset stage, the compensation stage, and the driving stage is $Ta+Tc+n\times Td$, and a maximum time duration of the displaying stage is $T-(Ta+Tc+n\times Td)$. In the related art, a minimum total duration of the driving stage is $n\times Tc$, and a maximum time duration of the displaying stage is $T-n\times Tc$. Since Ta is approximately equal to Td, Tc is typically 4 times Td, $Ta+Tc+n\times Td<n\times Tc$, $T-(Ta+Tc+n\times Td)>T-n\times Tc$; therefore, by adopting the technical solution provided by the present disclosure, the duration of the displaying stage S4 in a frame can be increased, and which facilitates to improve the light emitting efficiency of the light emitting element LED.

It should be noted that, when the pixel circuit in the display substrate include the fifth transistor T5 and the sixth transistor T6, the pixel circuits PIX in a same row correspond to a same second gate line Gate_B(1)/Gate_B(2), and the pixel circuits in a same column correspond to a same second data line Data_T(1)/Data_T(2)/Data_T(3).

Figure 8:
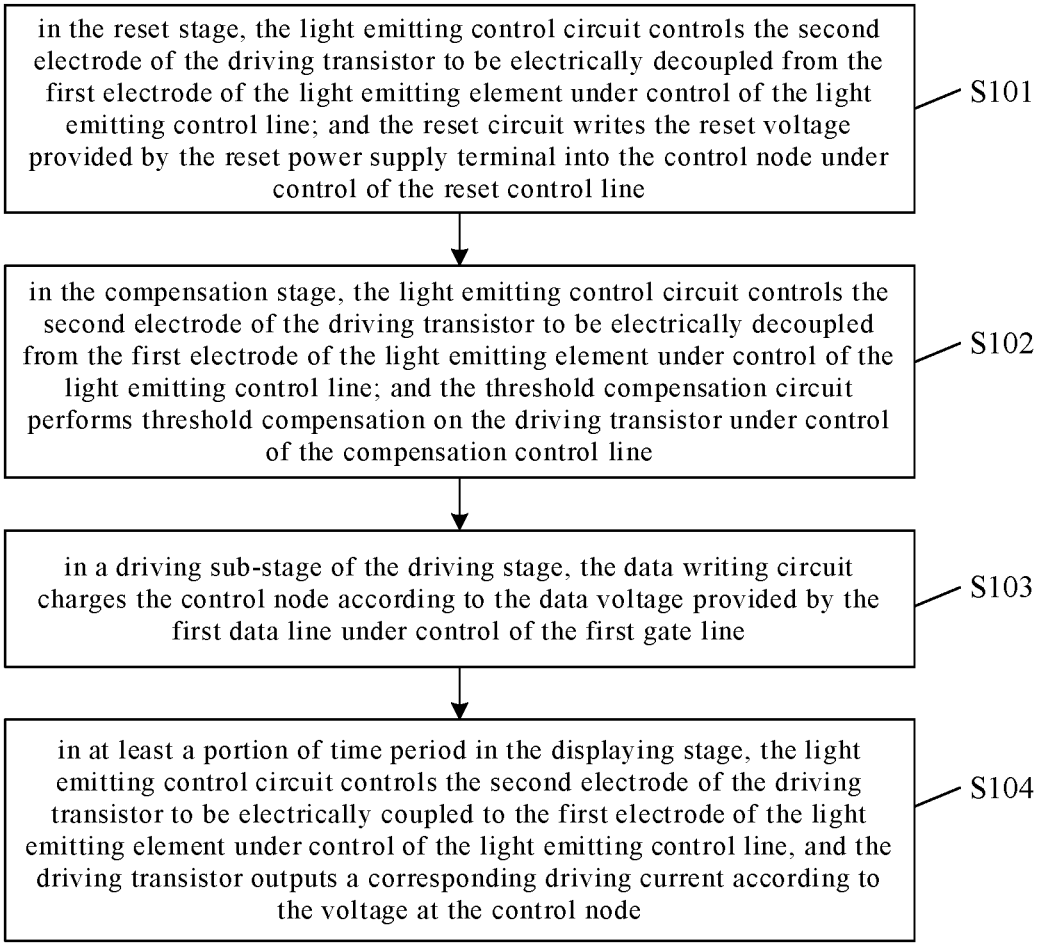
FIG. 8 is a flowchart of a driving method of a pixel circuit according to an embodiment of the present disclosure.

FIG. 8 is a flowchart of a driving method of a pixel circuit according to an embodiment of the present disclosure, and as shown in FIG. 8, the driving method corresponds to a pixel circuit, the pixel circuit adopts the pixel circuit provided in any of the foregoing embodiments, and for the description of the pixel circuit, reference may be made to the descriptions in the foregoing embodiments. The driving method of the pixel circuit includes the following steps S101 to 104.

Step S101, in the reset stage, the light emitting control circuit controls the second electrode of the driving transistor to be electrically decoupled from the first electrode of the light emitting element under control of the light emitting control line; and the reset circuit writes the reset voltage provided by the reset power supply terminal into the control node under control of the reset control line.

Step S102, in the compensation stage, the light emitting control circuit controls the second electrode of the driving transistor to be electrically decoupled from the first electrode of the light emitting element under control of the light emitting control line; and the threshold compensation circuit performs threshold compensation on the driving transistor under control of the compensation control line.

Step S103, in a driving sub-stage of the driving stage, the data writing circuit charges the control node according to the data voltage provided by the first data line under control of the first gate line.

The "driving sub-stage" in step S103 refers to a driving sub-stage corresponding to the pixel circuit (the driving signal provided by the first gate line is at an effective level).

Step S104, in at least a portion of time period in the displaying stage, the light emitting control circuit controls the second electrode of the driving transistor to be electrically coupled to the first electrode of the light emitting element under control of the light emitting control line, and the driving transistor outputs a corresponding driving current according to the voltage at the control node.

For the specific description of the steps S101 to S104, reference may be made to the foregoing descriptions of operation of the pixel circuit, and details are not repeated here.

Figure 9:
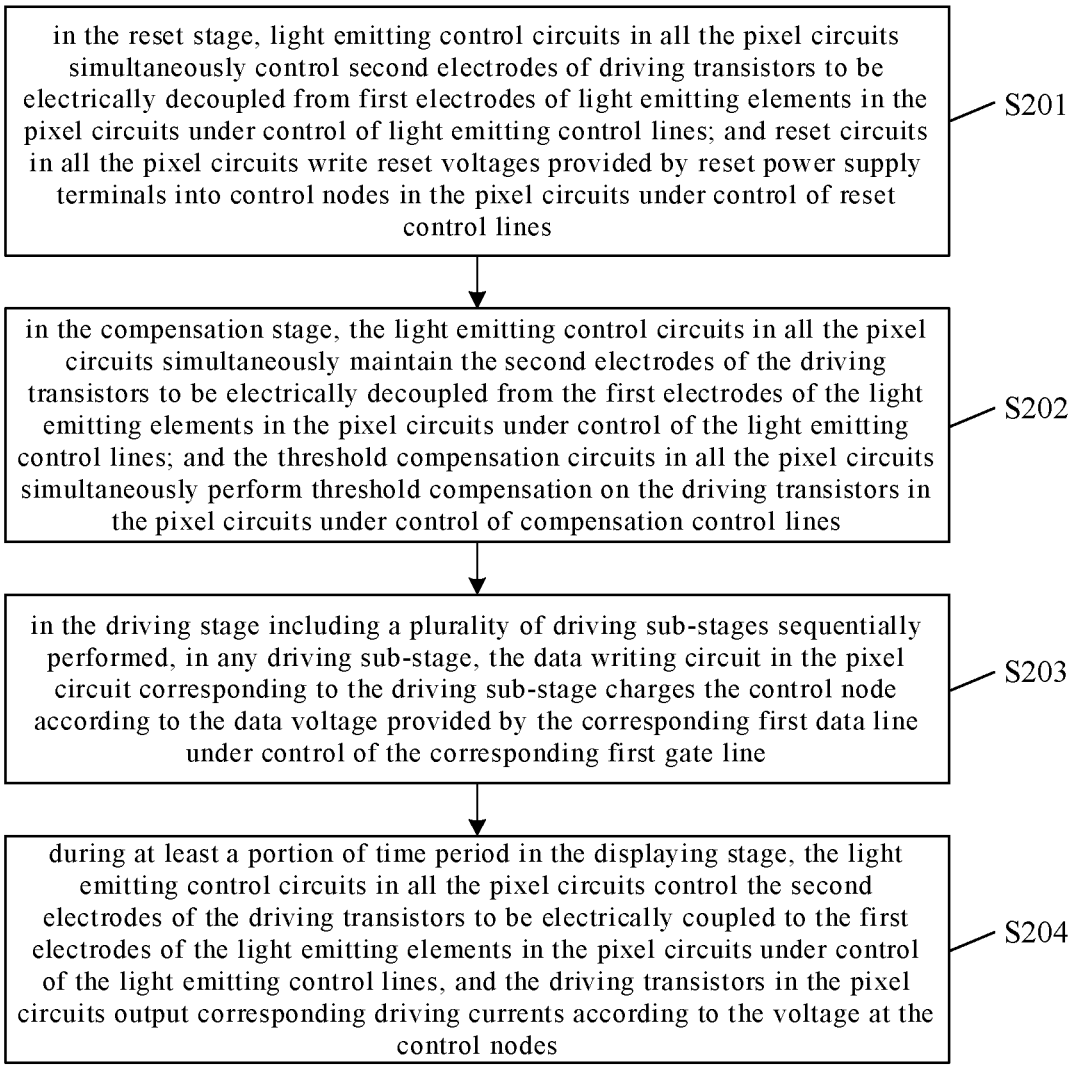
FIG. 9 is a flowchart of a driving method of a plurality of pixel circuits according to an embodiment of the present disclosure.

FIG. 9 is a flowchart of a driving method of a plurality of pixel circuits according to an embodiment of the present disclosure, and as shown in FIG. 9, the pixel circuits correspond to at least two first gate lines, where each pixel circuit is the pixel circuit provided in any of the foregoing embodiments. The driving method of the plurality of pixel circuits includes the following steps S201 to S204.

Step S201, in the reset stage, light emitting control circuits in all the pixel circuits simultaneously control second electrodes of driving transistors to be electrically decoupled from first electrodes of light emitting elements in the pixel circuits under control of light emitting control lines; and reset circuits in all the pixel circuits write reset voltages provided by reset power supply terminals into control nodes in the pixel circuits under control of reset control lines.

Step S202, in the compensation stage, the light emitting control circuits in all the pixel circuits simultaneously maintain the second electrodes of the driving transistors to be electrically decoupled from the first electrodes of the light emitting elements in the pixel circuits under control of the light emitting control lines; and the threshold compensation circuits in all the pixel circuits simultaneously perform threshold compensation on the driving transistors in the pixel circuits under control of compensation control lines.

Step S203, in the driving stage including a plurality of driving sub-stages sequentially performed, in any driving sub-stage, the data writing circuit in the pixel circuit corresponding to the driving sub-stage charges the control node according to the data voltage provided by the corresponding first data line under control of the corresponding first gate line.

Step S204, during at least a portion of time period in the displaying stage, the light emitting control circuits in all the pixel circuits control the second electrodes of the driving transistors to be electrically coupled to the first electrodes of the light emitting elements in the pixel circuits under control of the light emitting control lines, and the driving transistors in the pixel circuits output corresponding driving currents according to the voltage at the control nodes.

For the specific description of the steps S201 to S204, reference may be made to the forgoing descriptions of operations of the pixel circuit and the display device, and details are not repeated here.

According to the technical solution of the present disclosure, the pixel circuit in the display device is redesigned, so that the pixel circuits in the display device can simultaneously perform threshold compensation process on the driving transistors, the sum of the duration of the compensation stage and the duration of the driving stage is smaller than the total duration of the driving stage in the related art, the duration of the displaying stage for a frame is prolonged, and the light emitting efficiency of the light emitting element is favorably improved.

It should be understood that the above embodiments are merely exemplary embodiments employed to illustrate the principles of the present disclosure, and the present disclosure is not limited thereto. It will be apparent to those skilled in the art that various changes and modifications can be made therein without departing from the spirit and scope of the present disclosure, and these changes and modifications are to be considered within the scope of the present disclosure.

The invention claimed is:

1. A pixel circuit, comprising: a reset circuit, a threshold compensation circuit, a data writing circuit, a light emitting control circuit and a driving transistor, wherein the reset circuit, the threshold compensation circuit, the data writing circuit and a control electrode of the driving transistor are coupled to a control node;

the reset circuit is coupled to a reset control line and a reset power supply terminal and is configured to write a reset voltage provided by the reset power supply terminal into the control node under control of the reset control line;

the threshold compensation circuit is coupled to a compensation control line and is configured to perform threshold compensation on the driving transistor under control of the compensation control line;

the data writing circuit is coupled to a corresponding first gate line and a corresponding first data line and is configured to charge the control node according to a data voltage provided by the first data line under control of the first gate line;

the light emitting control circuit is coupled to a second electrode of the driving transistor, the light emitting control line and a first electrode of the light emitting element and is configured to control the second electrode of the driving transistor to be electrically coupled to or decoupled from the first electrode of the light emitting element under control of the light emitting control line;

a first electrode of the driving transistor is coupled to a first operating power supply terminal, and the driving transistor is configured to output a corresponding driving current according to a voltage at the control node in response to that the second electrode of the driving transistor is electrically coupled to the first electrode of the light emitting element.

2. The pixel circuit of claim 1, wherein the threshold compensation circuit comprises: a first transistor;

a control electrode of the first transistor is coupled to the compensation control line, a first electrode of the first transistor is coupled to the control node, and a second electrode of the first transistor is coupled to the second electrode of the driving transistor.

3. The pixel circuit of claim 1, wherein the reset circuit comprises: a second transistor;

a control electrode of the second transistor is coupled to the reset control line, a first electrode of the second transistor is coupled to the control node, and a second electrode of the second transistor is coupled to the reset power supply terminal.

4. The pixel circuit of claim 1, wherein the data writing circuit comprises: a third transistor and a first capacitor;

a control electrode of the third transistor is coupled to the first gate line, a first electrode of the third transistor is coupled to the first data line, and a second electrode of the third transistor is coupled to a first electrode of the first capacitor;

a second electrode of the first capacitor is coupled to the control node.

5. The pixel circuit of claim 1, wherein the light emitting control circuit comprises: a fourth transistor;

a control electrode of the fourth transistor is coupled to the light emitting control line, a first electrode of the fourth transistor is coupled to the second electrode of the driving transistor, and a second electrode of the fourth transistor is coupled to the first electrode of the light emitting element.

6. The pixel circuit of claim 1, wherein the light emitting control circuit comprises: a fourth transistor, a fifth transistor, a sixth transistor, and a second capacitor;

a control electrode of the fourth transistor is coupled to the light emitting control line, a first electrode of the fourth transistor is coupled to the second electrode of the driving transistor, and a second electrode of the fourth transistor is coupled to a first electrode of the sixth transistor;

a control electrode of the fifth transistor is coupled to a second gate line, a first electrode of the fifth transistor is coupled to a second data line, and a second electrode of the fifth transistor is coupled to a control electrode of the sixth transistor;

the control electrode of the sixth transistor is coupled to a first electrode of the second capacitor, and a second electrode of the sixth transistor is coupled to the first electrode of the light emitting element;

a second electrode of the second capacitor is coupled to a common power supply terminal.

7. The pixel circuit of claim 1, wherein all transistors in the pixel circuit are N-type transistors; or all transistors in the pixel circuit are P-type transistors.

8. A display device, comprising a display substrate, wherein the display substrate comprises a plurality of light emitting elements thereon, and at least one of the light emitting elements is coupled to the pixel circuit of claim 1.

9. The display device of claim 8, wherein each of light emitting elements, more than or equal to 2 in number, of the plurality of light emitting elements, is coupled to the pixel circuit;

at least two pixel circuits are simultaneously coupled to a same reset control line, at least two pixel circuits are simultaneously coupled to a same compensation control line, and at least two pixel circuits are simultaneously coupled to a same light emitting control line.

10. A driving method of the pixel circuit of claim 1, the driving method comprising:

in a reset stage, controlling, by the light emitting control circuit, the second electrode of the driving transistor to be electrically decoupled from the first electrode of the light emitting element under control of the light emitting control line; and writing, by the reset circuit, a reset voltage provided by the reset power supply terminal into the control node under control of the reset control line;

in a compensation stage, controlling, by the light emitting control circuit, the second electrode of the driving transistor to be electrically decoupled from the first electrode of the light emitting element under control of the light emitting control line; and performing, by the threshold compensation circuit, threshold compensation on the driving transistor under control of the compensation control line;

in a driving sub-stage of a driving stage, charging, by the data writing circuit, the control node according to a data voltage provided by the first data line under control of the first gate line;

in at least a portion of time period in a displaying stage, controlling, by the light emitting control circuit, the second electrode of the driving transistor to be electrically coupled to the first electrode of the light emitting element under control of the light emitting control line, and outputting, by the driving transistor, a corresponding driving current according to a voltage at the control node.

11. A driving method of a plurality of pixel circuits, each of which is the pixel circuit of claim 1, and the pixel circuits correspond to at least two first gate lines, the driving method comprising:

in a reset stage, simultaneously controlling, by light emitting control circuits in all the pixel circuits, second electrodes of driving transistors in the pixel circuits to be electrically decoupled from first electrodes of light emitting elements under control of light emitting control lines; and writing, by reset circuits in all the pixel circuits, reset voltages provided by reset power supply terminals into control nodes in the pixel circuits under control of reset control lines;

in a compensation stage, simultaneously maintaining, by light emitting control circuits in all the pixel circuits, the second electrodes of the driving transistors to be electrically decoupled from the first electrodes of the light emitting elements in the pixel circuits under control of the light emitting control lines; and simultaneously performing, by threshold compensation circuits in all the pixel circuits, threshold compensation on the driving transistors in the pixel circuits under control of compensation control lines;

in a driving stage including a plurality of driving sub-stages sequentially performed, in any driving sub-stage, charging, by the data writing circuit in the pixel circuit corresponding to the driving sub-stage, the control node according to a data voltage provided by the corresponding first data line under control of the corresponding first gate line;

in at least a portion of time period in a displaying stage, controlling, by the light emitting control circuits in all the pixel circuits, the second electrodes of the driving transistors to be electrically coupled to the first electrodes of the light emitting elements in the pixel circuits under control of the light emitting control lines, and outputting, by the driving transistors in the pixel circuits, corresponding driving currents according to voltages at the control nodes.

12. The pixel circuit of claim 1, wherein the threshold compensation circuit comprises: a first transistor;

a control electrode of the first transistor is coupled to the compensation control line, a first electrode of the first transistor is coupled to the control node, and a second electrode of the first transistor is coupled to the second electrode of the driving transistor, the reset circuit comprises: a second transistor;

a control electrode of the second transistor is coupled to the reset control line, a first electrode of the second transistor is coupled to the control node, and a second electrode of the second transistor is coupled to the reset power supply terminal.

13. The pixel circuit of claim 1, wherein the threshold compensation circuit comprises: a first transistor;

a control electrode of the first transistor is coupled to the compensation control line, a first electrode of the first transistor is coupled to the control node, and a second electrode of the first transistor is coupled to the second electrode of the driving transistor, the reset circuit comprises: a second transistor;

a control electrode of the second transistor is coupled to the reset control line, a first electrode of the second transistor is coupled to the control node, and a second electrode of the second transistor is coupled to the reset power supply terminal, the data writing circuit comprises: a third transistor and a first capacitor;

a control electrode of the third transistor is coupled to the first gate line, a first electrode of the third transistor is coupled to the first data line, and a second electrode of the third transistor is coupled to a first electrode of the first capacitor;

a second electrode of the first capacitor is coupled to the control node.

14. The pixel circuit of claim 13, wherein the light emitting control circuit comprises: a fourth transistor;

a control electrode of the fourth transistor is coupled to the light emitting control line, a first electrode of the fourth transistor is coupled to the second electrode of the driving transistor, and a second electrode of the fourth transistor is coupled to the first electrode of the light emitting element.

15. The pixel circuit of claim 13, wherein the light emitting control circuit comprises: a fourth transistor, a fifth transistor, a sixth transistor, and a second capacitor;

a control electrode of the fourth transistor is coupled to the light emitting control line, a first electrode of the fourth transistor is coupled to the second electrode of the driving transistor, and a second electrode of the fourth transistor is coupled to a first electrode of the sixth transistor;

a control electrode of the fifth transistor is coupled to a second gate line, a first electrode of the fifth transistor is coupled to a second data line, and a second electrode of the fifth transistor is coupled to a control electrode of the sixth transistor;

the control electrode of the sixth transistor is coupled to a first electrode of the second capacitor, and a second electrode of the sixth transistor is coupled to the first electrode of the light emitting element;

a second electrode of the second capacitor is coupled to a common power supply terminal.

* * * * *